US005636972A

United States Patent [19]

Richter et al.

[11] Patent Number: 5,636,972

[45] Date of Patent: Jun. 10, 1997

[54] DEVICE FOR EXTRUSION OF TWO COMPONENT SYNTHETIC RESINS

[75] Inventors: Archibald Richter, Essen; Udo Nielbock, Dorsten; Heinrich Rütter, Gladbeck, all of Germany

[73] Assignee: Carbotech, Essen, Germany

[21] Appl. No.: 225,946

[22] Filed: Apr. 8, 1994

[30] Foreign Application Priority Data

Apr. 26, 1993 [DE] Germany ..... 9306278 U

[51] Int. Cl.[6] ..... F04B 23/10; F04B 23/02; E21D 9/00; E21D 13/04

[52] U.S. Cl. ..... 417/199.1; 222/135; 222/464.7; 405/150.2; 405/267

[58] Field of Search ..... 417/199.1, 201, 417/203, 205, 531; 222/135, 464.7, 145.1, 145.5, 334, 396; 405/150.2, 266, 267, 268, 269

[56] References Cited

U.S. PATENT DOCUMENTS

| | | | |
|---|---|---|---|
| 1,967,260 | 7/1934 | Rayfield | 417/201 |
| 2,726,604 | 12/1955 | Aspelin et al. | 417/203 |
| 2,903,248 | 9/1959 | Walker | 417/201 |
| 3,540,626 | 11/1970 | Eberle | 222/135 |
| 3,621,892 | 11/1971 | Gillespie | 222/145.5 |
| 3,773,300 | 11/1973 | Hauser | 222/135 |
| 4,019,652 | 4/1977 | Suh et al. | 222/145.5 |
| 4,432,470 | 2/1984 | Sopha | 222/135 |
| 4,634,024 | 1/1987 | Vollenweider | 222/135 |
| 4,787,826 | 11/1988 | Schnell | 417/203 |
| 4,881,820 | 11/1989 | Lückhoff | 222/135 |
| 5,390,825 | 2/1995 | Rockel | 222/135 |
| 5,505,591 | 4/1996 | Tynan | 417/205 |

FOREIGN PATENT DOCUMENTS

| | | | |
|---|---|---|---|
| 37294 | 10/1981 | European Pat. Off. | 417/201 |

*Primary Examiner*—Timothy Thorpe
*Assistant Examiner*—William Wicker
*Attorney, Agent, or Firm*—John W. Carpenter

[57] ABSTRACT

A device for the extrusion of two component or two-part synthetic resins, in particular in underground mining and tunnel construction, which essentially consists of an extrusion pump in the form of an axial piston pump, exhibiting or having two pump stages or steps, located in a transportable frame, whereby each pump stage or step is connectable to reservoirs containing the synthetic resin components or parts via hose lines.

14 Claims, 2 Drawing Sheets

DEVICE FOR EXTRUSION OF TWO COMPONENT SYNTHETIC RESINS

The present invention concerns a device for the extrusion of two component or two-part synthetic resins, in particular in underground mining and tunnel construction, which essentially consists of an extrusion pump in the form of an axial piston pump, exhibiting or having two pump stages or steps, located in a transportable frame, whereby each pump stage or step is connectable to reservoirs containing the synthetic resin components or parts via hose lines.

The device of known construction consists essentially of two pump stages or steps sitting on a common axial drive shaft, driven by, for example, a compressed air motor. Such an extrusion pump is usually located in a circumferential tubular frame which ensures appropriate transport and offers protection against rock and coal fall.

SUMMARY OF THE INVENTION

For the extrusion process, canisters are connected with corresponding components (i.e., of the resin to be extruded) to the respective suction line. With tin canisters as currently used, the lid of the canister first must be cleaned before opening. With introduction of the suction hose into the canister opening, the opening must be secured against contamination. Small rocks or coal particles which reach the pump through the suction hose can block or significantly impair the pump's efficiency. The previous or prior art systems do not allow for any continual and efficient injecting and/or extruding.

A further problem lies in the structure of the tin canisters or containers, which, due to their construction, scarcely allow for internal cleaning and are thus utilizable only for single use.

The task underlying the invention is to create a device for the extrusion of two component or two-part synthetic resins which, proceeding from the development to date, makes possible an efficient extrusion adapted for environmental preservation and reasonable and economical in view of the use of canisters.

The task is solved according to the invention in that the pump is located between two reservoirs in a common frame construction, and that assigned to each pump stage or step is an additional reservoir or gear pump for filling the reservoirs from the returnable tin canisters or containers by means of lines.

The envisioned device, which receives the two parts or components in corresponding reservoirs, can make a continual and economical extrusion possible on the basis of the additional reservoir or gear pumps through suctioning of the separate parts or components from the so-called returnable tin canisters or containers.

The additional pumps (i.e., the reservoir or gear pumps), integrated into the frame construction or otherwise coupled to the frame contstruction, are provided in the form of gear pumps having a robust and/or sturdy construction for the prescribed constant supply.

The total unit is to be transported through the usual means of underground transport—by pulling, hanging or on a car. The returnable containers, (e.g., tin canisters) which can be emptied with hose lines via special couplings, are arranged one behind the other, adapted to the geometry of monorail conveyer troughs, or also set into a protective frame to be transported in a suitable manner by monorail conveyer troughs intended for moving ore.

The returnable containers (e.g., tin canisters) can be emptied in an advantageous manner, as well as nearly drop free, via an off take pipe, by connecting the suction line onto the filling and emptying port by means of a special coupling.

In the container top surface is additionally located an air evacuation port. By utilizing a drying cartridge, no moisture penetrates into the returnable container thus obviating internal cleaning of the container before filing or after refilling.

A particular advantage of this extrusion device is that the reservoir in the frame construction forms a closed system with a returnable container during the filling process. Located alongside the filling line which connects the container is an additional hose line, intended as an air evacuation line, connected via corresponding connections. This air evacuation line inhibits the escape of air that is freed up in the reservoir during filling into the surrounding environment. This air is guided into the returnable tin canister or container via an air evacuation port which is equipped with the aforementioned drying cartridge.

When cleaning should actually be needed following a number of rounds, it can be achieved via a screwed down cleaning lid which provides access to a correspondingly large opening in order to access the container with the appropriate devices.

The filling and emptying port as well as the cleaning lid, and the air evacuation port in particular in connection with the drying cartridge, are protected from damage in the container top surface by a circumferential, open work collar designed for self-cleaning.

The manner of transport as well as the possibility of an appropriate emptying and filling without an additional cleaning process make it possible to minimize turn around times. In addition to this, the arrangement of the containers in a transport frame, which can likewise fit in conventional transport troughs, offers secure protection against destruction and contributes to improved environmental protection through quick circulation time.

A design example of the invention is depicted in the drawings and is explained in the following in greater detail. These show:

DETAILED DESCRIPTION OF THE DRAWINGS

Figure 1:
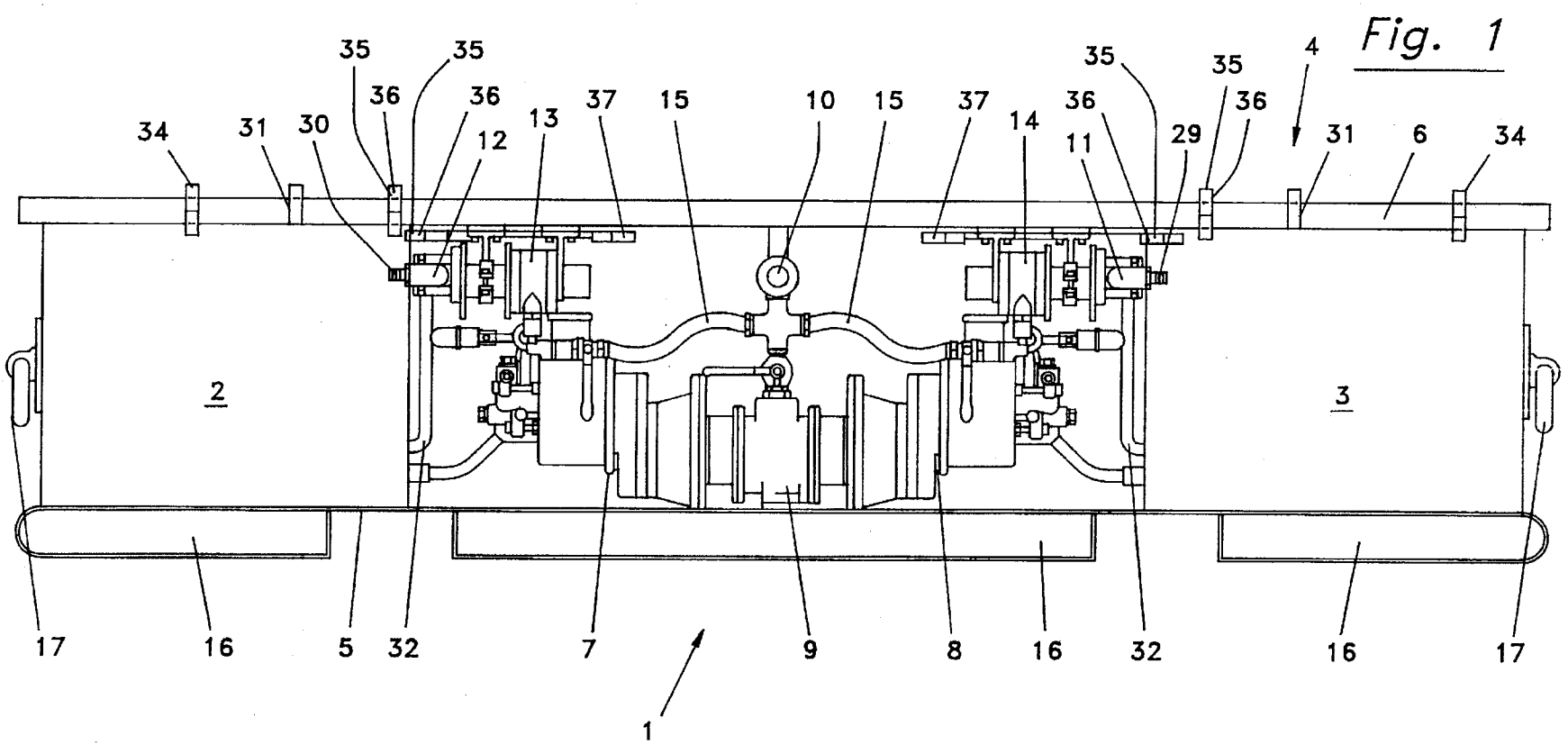
FIG. 1 is a schematic side view of a common frame construction carrying two reservoirs and the pump.

The design example depicted in FIG. 1 in side view shows a frame assembly or construction 4 in which a pump 1 in the form of an axial piston pump is centrally located with two pump stages or steps 7 and 8 and a corresponding motor 9. Pump 1 with the pump stages or steps 7 and 8 is driven by the common motor 9 (e.g., a pneumatic motor) for which an air supply 10 is provided. Located in the common frame assembly or construction 4 on each side of the pump 1 are reservoirs 2 and 3, respectively, each for receiving one of two distinct synthetic resin components or parts.

The common frame construction or assembly 4 is essentially formed by a correspondingly common floor panel 5 and a circumferential top side carrier 6. Additionally, integrated into or disposed in the frame construction or assembly 4 on each side of pump 1 are reservoir or gear pumps 11 and 12 which are driven, respectively, by compressed air motors 13 and 14 via air supply Line 15. The gear pumps 11 and 12 are connected with returnable containers 18 (see FIGS. 2 and 3) for suctioning and filling reservoirs 2 and 3 via hose lines (not depicted), as is reflected in FIGS. 2 and 3.

Frame construction or assembly 4, which is set, at least in part, on skids 16, exhibits carrying or pulling elements on the heads or ends in the form of hoist rings 17.

Figure 2:
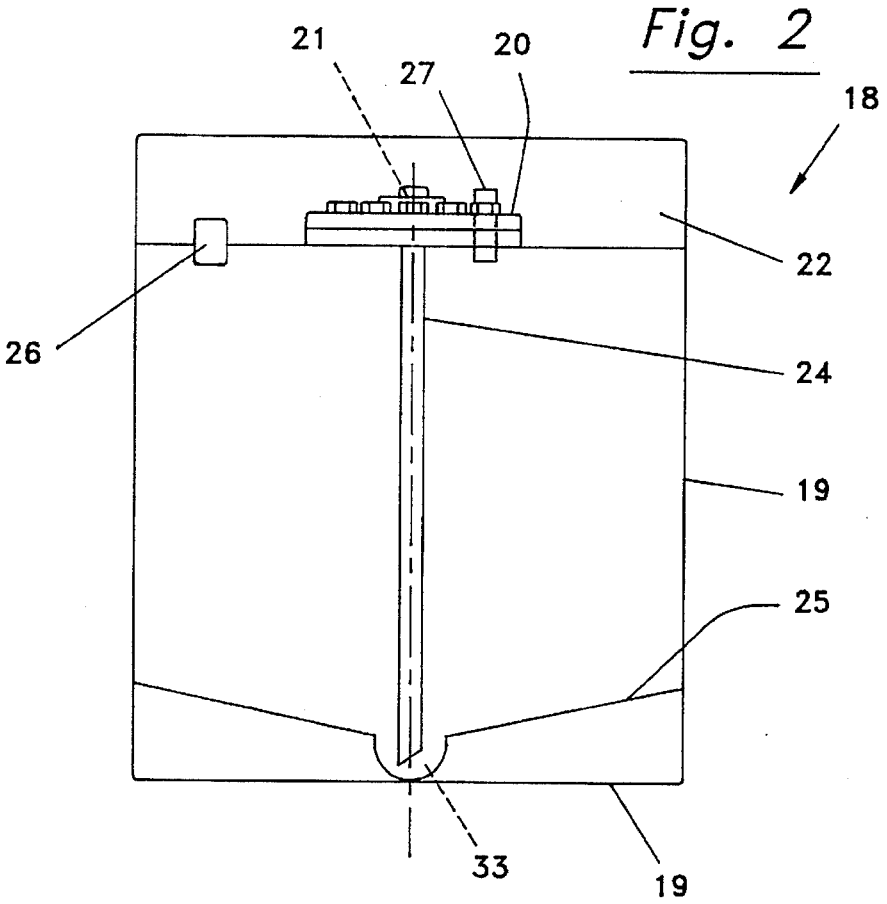
FIG. 2 is a side view of a returnable container in cross section.
Figure 3:
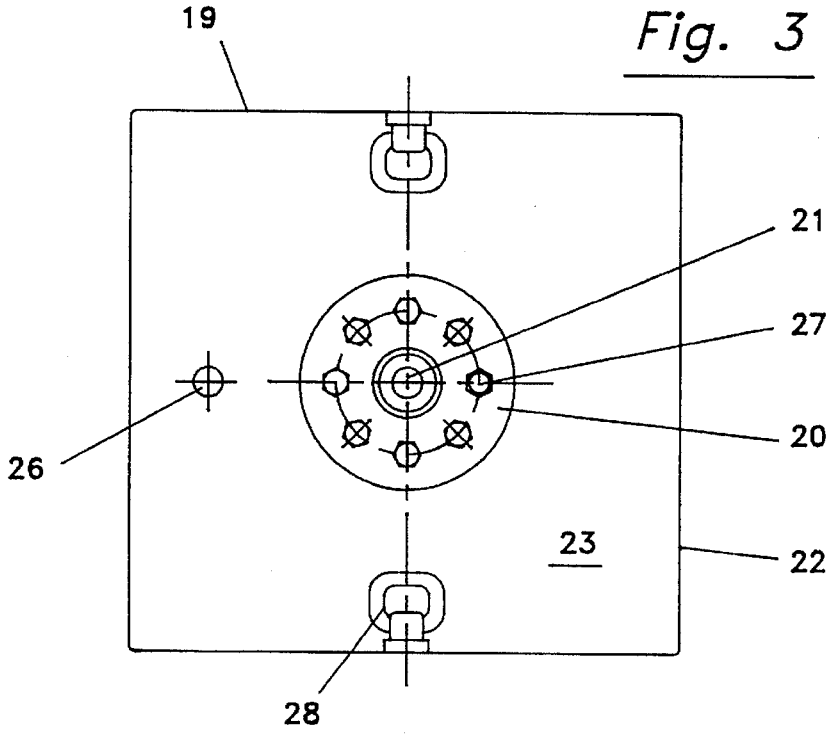
FIG. 3 is a top view of a returnable container.

The returnable containers 18, depicted as a design example in FIGS. 2 and 3, exhibit an edge length 19, for example, of 500 mm, and are transportable in connection with a not shown transport frame equipped with bearing elements, with five respective containers 18. Alternatively, the transport frames, or also the returnable containers 18, are transportable in underground mines in conventional transport troughs.

The returnable containers 18 exhibit a circumferential, open work collar 22 above a container top surface 23. Centrally in the container top surface is provided a cleaning lid 20 that is removable by means of screws, in which a pressure control valve 27 is located. Additionally located in the container top surface 23 is an air evacuation port 26. Beneath the filling and emptying port 21, in the very bottom of the funnel shaped floor 25, is a depression 33 into which an off take pipe 24 reaches, by means of which a nearly complete and drop free emptying of the returnable container 18 is possible.

For transport of single containers, two hoist rings 28 are provided, especially lying opposite one another, within circumferential collar 22. The transport frames (not shown) receiving the containers 18 have corresponding recesses for transport by means of fork lift or similar device.

In order to be able to carry out the filling process of reservoirs 2 and 3 and the attendant emptying process of the returnable containers 18 in an environmentally friendly manner consistent with the stated task, during the filling process (i.e., of the reservoirs 2 and 3) a closed system is provided. The hose line (not shown) provided for filling interconnects the filling and emptying port 21 of a returnable container 18, and the product supply line 32 of corresponding pump 11/12. Additionally, a shuttle line (also not shown), in the form of a hose line, is connected to air evacuation port 26 of returnable container 18. Reservoirs 2 and 3 are additionally equipped with a pressure control valve 34. In order to hinder penetration of moisture during filling, a line connection 35 is located on reservoirs 2 and 3, which is, in turn, connected with a non-return valve 36 having a drying cartridge 37 via a hose. For considerations of space, the assemblies 35/36/37 can also be located on the side of the corresponding reservoir 2/3.

Reference List

1 Pump
2,3 Reservoirs
4 Frame Construction
5 Bottom Plate
6 Circumferential Carrier
7 Pump Step
8 Pump Step
9 Motor
10 Air Supply
11 Gear Pump
12 Gear Pump
13 Motor
14 Motor
15 Air Supply Line
16 Skids
17 Hoist Ring
18 Returnable Container
19 Edge Length
20 Cleaning Lid
21 Filling and Emptying Port
22 Circumferential Collar
23 Container Top Surface
24 Off Take Pipe
25 Floor
26 Air Evacuation Port
27 Pressure Control Valve
28 Hoist Rings
29 Hose Connection
30 Hose Connection
31 Air Evacuation Port for Shuttle Line on the Reservoir
32 Product Supply Line of Pump from Returnable Container
33 Depression
34 Pressure Control Valve (Reservoirs)
35 Line Connection for Drying Cartridge with Line
36 Non-Return Valve for Drying Cartridge
37 Drying Cartridge

I claim:

1. A device for extrusion of two component synthetic resins, in particular for underground mining and tunnel construction, comprising an extrusion pump (1) in the form of an axial piston pump, having two pump stages (7,8) supported by a transportable frame (4), wherein each pump stage is connectable to a corresponding reservoir (2,3) containing synthetic resin components; wherein said pump (1) is located between said reservoirs (2,3) in said transportable frame (4); and a pair of reservoir pumps (11,12) supported by said transportable frame (4) and communicating with said reservoirs; at least two returnable containers for supplying a component of a two-component synthetic resin to said reservoirs (2,3) and communicating with said reservoir pumps such that said reservoir pumps may fill said reservoirs (2,3) from said at least two returnable containers (18).

2. Device for Extrusion in accordance with claim 1, wherein said reservoir pumps (11,12) are coupled to the said frame (4) on each side of said extrusion pump (1).

3. Device for Extrusion in accordance with claim 1, wherein said reservoirs are each equipped with an air evacuation port (31) and a pressure control valve (34) for connecting to a shuttle line.

4. Device for Extrusion in accordance with claim 3, wherein said returnable containers include edge lengths (19).

5. Device for Extrusion in accordance with claim 4, wherein located in a container top surface (23) of one of the returnable containers (18) is a pressure control valve (27) and an air evacuation port (26) for being connected via a shuttle line with said air evacuation port (31) of corresponding said reservoirs (2,3).

6. Device for Extrusion in accordance with claim 5, wherein said container top surface has said pressure control valve (27) in a cleaning lid (20); and said container top surface comprises a circumferential collar (22).

7. Device for Extrusion in accordance with claim 6, wherein said cleaning lid is removably connected to said container top surface.

8. Device for Extrusion in accordance with claim 1, wherein said reservoir pumps comprise gear pumps.

9. Device for Extrusion in accordance with claim 1, wherein the frame is equipped with skids (16).

10. Device for Extrusion in accordance with claim 1, wherein the frame is equipped at each end with frame transport elements; said frame transport elements comprising hoist rings (17).

11. Device for Extrusion in accordance with claim 10, wherein transport elements are secured to the inside of a circumferential collar (22) coupled around one of said containers (18).

12. Device for Extrusion in accordance with claim 1, wherein an off take pipe (24) is connected with a filling and emptying port (21) of each of said returnable container.

13. Device for Extrusion in accordance with claim 12, wherein a floor (25) of each of said returnable containers is funnel shaped.

14. Device for Extrusion in accordance with claim 13, wherein a depression (33) into which said off take pipe (24) reaches is located centrally in said funnel shaped floor (25) of each of said returnable containers (18).

* * * * *